United States Patent [19]

Auriemma

[11] 4,111,581

[45] Sep. 5, 1978

[54] HIGHWAY MARKER

[76] Inventor: Robert S. Auriemma, Rte. #1 Box 104, Bethel, Pa. 19507

[21] Appl. No.: 866,261

[22] Filed: Jan. 3, 1978

[51] Int. Cl.[2] ..... E01F 9/00

[52] U.S. Cl. ..... 404/10

[58] Field of Search ..... 404/10, 11, 13, 14

[56] References Cited

U.S. PATENT DOCUMENTS

| | | | |
|---|---|---|---|
| 1,676,843 | 7/1928 | Stephens | 404/10 |
| 1,773,487 | 8/1930 | Hines | 404/10 |
| 2,519,145 | 8/1950 | Manly | 404/11 |
| 2,774,323 | 12/1956 | Kirk | 404/10 X |
| 3,340,779 | 9/1967 | Mahoney | 404/10 |
| 3,963,362 | 6/1976 | Hollis | 404/10 |

FOREIGN PATENT DOCUMENTS

| | | | |
|---|---|---|---|
| 1,094,128 | 12/1954 | France | 404/10 |
| 1,372,878 | 11/1974 | United Kingdom | 404/10 |

*Primary Examiner*—Nile C. Byers
*Attorney, Agent, or Firm*—Thomas Hooker

[57] ABSTRACT

A highway marker having a base inserted into a hole formed in highway pavement so that the upper surface of the base is below the surface of the pavement and an integral upstanding flexible tab which projects above the surface of the highway. A light reflecting member is secured on one side of the tab for reflecting light directed against the member to indicate the location of the marker. The height of the tab is less than the distance from the base of the tab to the side of the marker facing away from the light reflecting member so that when a vehicle is driven over the marker the tab is bent down against the top of the base below the surface of the pavement and flexes back to the upright position upon passage of the vehicle. The surface of the light reflecting member may be angled back at a 4° angle with respect to the vertical to improve reflection back to drivers of vehicles approaching the marker.

6 Claims, 6 Drawing Figures

HIGHWAY MARKER

This invention relates to markers affixed in highway pavement to indicate the location of a particular feature of a highway, such as dividing lines between the lanes, dividing lines for separating lanes of oncoming traffic or for indicating the edge of the pavement. Highway markers of this type have a reflecting member projecting above the surface of the highway to reflect back light directed against it. These kinds of highway markers are disclosed in U.S. Pat. Nos. 3,340,779, 3,890,054, and 3,963,362.

In the present invention, the highway marker includes an integral upstanding tab projecting above the upper surface of the resilient base. The base is positioned within a bore in the highway pavement a distance below the surface of the pavement and has a surface extent to one side of the tab sufficient that when an automobile tire, snow plow, or the like engages the tab it is bent down and rests flush against the base below the surface of the pavement. The tab flexes back to the upright visual position when it is released.

In a first embodiment of the invention the tab is located adjacent one side of the base and carries a reflective member facing that side of the base. The marker is oriented in the pavement with the reflective member facing oncoming traffic so that when traffic engages the tab it is bent down against the upper surface of the base extending away from the traffic. This design allows for particularly compact highway markers.

In a second embodiment of the invention intended to be used to indicate the position of the marker to traffic moving in either of two opposite directions, the tab is located centrally on an enlarged base and carries reflecting material on both sides. In this marker, the base is sufficiently large to permit the tab to be flexed down against the surface of the base in either of two directions, depending upon the direction of movement of the vehicle engaging the tab.

In both embodiments, the tab includes a specialized pocket for receiving and holding a reflective sheeting. The sheeting is confined within the recess below the outer surface of the tab which is engaged by the vehicle when the tab is flexed down against the base so as to protect the sheeting from wear. Accidental engagement between the sheeting and, say, one tire of a vehicle passing over the marker, tends to seat the sheeting more firmly in the recess rather than to remove the sheeting from the recess. Preferably, the sheeting is confined within the recess of the highway marker at an angle of 4° back from vertical to improve reflection of light received from low beams back to the driver of the vehicle.

Other objects and features of the invention will become apparent as the description proceeds, especially when taken in conjunction with the accompanying drawings illustrating the invention, of which there is one sheet.

IN THE DRAWING

Figure 4:
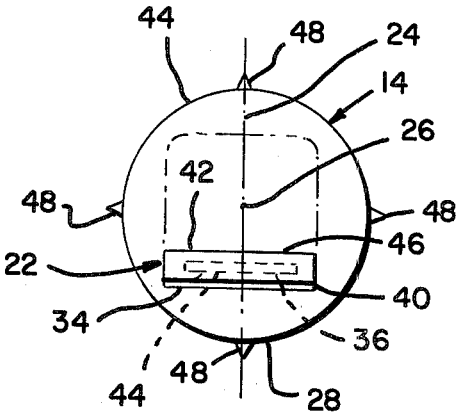
FIG. 4 is a top view of the highway marker of FIG. 1.

Referring to FIGS. 1–4,

Highway marker 10 includes a molded resilient body 12 preferably formed from a flexible and resilient material such as a neoprene rubber. The body 12 includes a base 14 having a cylindrical side wall 16 and flat parallel lower and upper end surfaces 18 and 20. An integral reflecting tab 22 extends upwardly above surface 20. Tab 22 has a generally planiform shape and, as illustrated in FIG. 4, extends across the longitudinal axis 24 of marker 10 between the radical center 26 of base 14 and the forward side 28 of wall 16.

Figure 1:
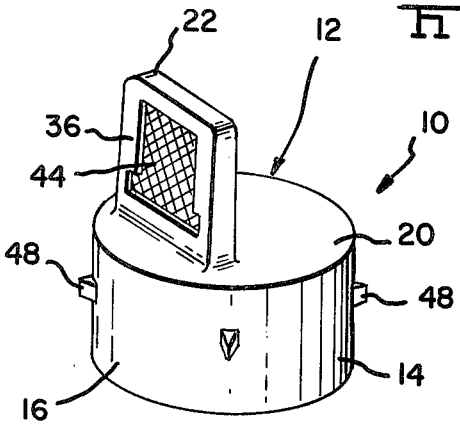
FIG. 1 is a perspective view of a highway marker according to the invention.
Figure 2:
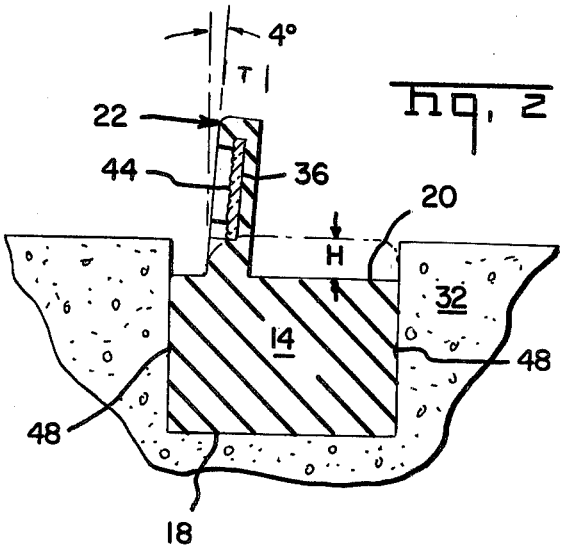
FIG. 2 is a sectional view illustrating the marker in position in highway pavement.
Figure 3:
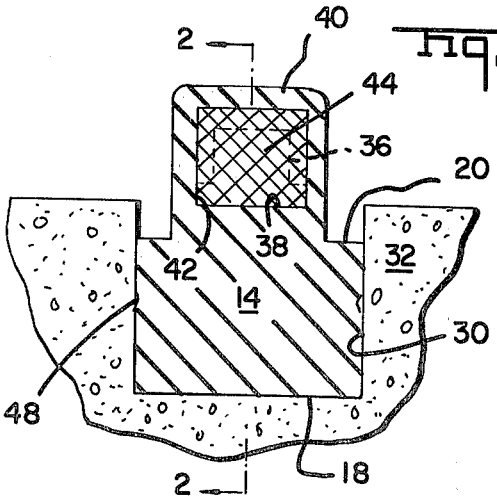
FIG. 3 is a sectional view taken on line 3—3 of FIG. 2.

Marker 10 is positioned in bore 30 in pavement 32 with the forward side 28 of the base and with front side 34 of the tab facing oncoming traffic. As illustrated in FIG. 2, the bore 30 has a depth sufficient to position the upper surface 20 a distance H beneath the surface of the pavement. This distance H is equal or greater to the thickness T of the tab 32.

The front or traffic-facing side 32 of tab 22 includes a rectangular recess 36 generally conforming to the shape of the tab and having a lower edge 38 spaced above the upper surface 20 of base 14 approximately distance H. A retaining lip 40 extends around the upper three sides of recess 36 with the ends of the lip being spaced from the bottom side 38 of the recess to provide a loading slot 42 at the bottom of the recess. The slot has a width equal to the width of the recess. Prior to insertion of highway marker 10 in the pavement, a rectangular reflective sheeting member 44 is inserted into the recess 36 by bending rear side 46 of the tab down against the top of the base to open the slot 42 and thereby permit the member 44 to be moved through the slot and into the recess. The sides of the sheet fit closely within the recess and are sandwiched between the lip and the back of the recess. The central part of the sheeting is exposed to reflect light directed thereon and provide a highly visable highway marker.

The base 14 includes a number of integral projections 48 spaced around the circumference of wall 16. The projections aid in holding the highway marker in place in the pavement. Ideally, the diameter of the bore 30 is slightly less than the diameter of base 14 so that the marker may be inserted within the bore by slightly compressing the base to form a tight compression fit with the pavement. In practice, however, it is not possible to assure the diameter of the bore is constant and, for this reason, the body is provided with projections 48. During insertion the body into the bore 30 the projections 48 are bent upwardly toward the pavement surface and provide pressure points to assure a tight fit between the body and oversized bores 30. Projection may also be used for this purpose.

As illustrated in FIG. 2, the front face 34 of free standing tab 22 angles back from the vertical by an angle of approximately 4° so that the reflective surface of sheeting 44 is likewise oriented at a 4° angle from the vertical. Normally, vehicle low headlight beams are aimed down at a 4° angle. With the highway marker 10 properly positioned in the pavement, and with the sheeting angled back at 4° from the vertical, the reflective surface of the sheeting is perpendicular to the low beam and efficiently reflects the beam back to the driver.

The height of the tab 22 is less than the distance from the base of the tab to the rearward side 44 of wall 16. This means that when the tab is the path of tires of oncoming traffic the tires engage the tab and bend it rearwardly as illustrated in FIG. 2 until the tab is within the recess between the surface of the pavement and upper surface 20 of the base 14. After passage of the traffic the tab flexes back up to reposition the sheeting in the light reflecting position. The tab is bent down in the recess similiarly when engaged by snow plow blades, scrappers, or by other pavement engaging members.

The area of engagement between the tab and the tires is relatively small, in comparison with the total area of engagement between the tire and the pavement so that there is little injury to the tab when it is run over and bent down. The reflective sheeting 44 is recessed below the tire-engaging front surface 34 of the tab and does not normally touch the vehicle tire. Engagement between the tire and the sheeting would tend to force the sheeting against the top of the recess and away from slot 42 so that accidental dislodgement of the sheeting is minimized. p As indicated previously, the body and tab of highway marker 10 are preferrably formed from a flexible resilient neoprene rubber material. The rubber may have a durometer hardness of about 60. Obviously, other types of materials may be used provided they have the flexibility and resilience required to permit the tab to be bent down and then flex back upright.

Figure 5:
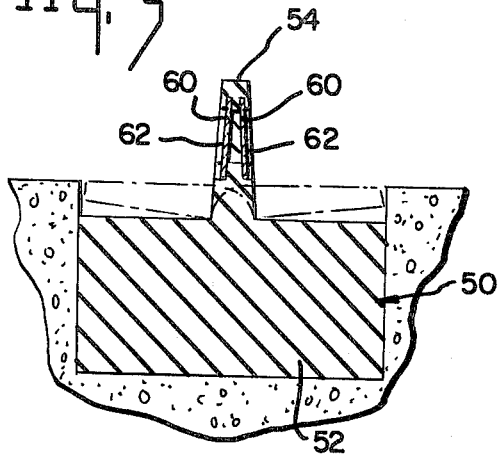
FIG. 5 is a sectional view of a second embodiment of the invention.
Figure 6:
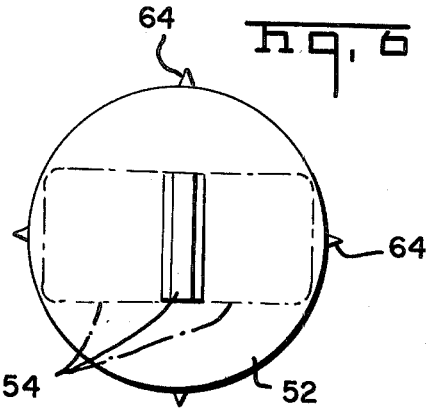
FIG. 6 is a top view of the highway marker of FIG. 5.

FIGS. 5 and 6 illustrate a second embodiment of the invention relating to a highway marker 50 intended to be used to mark traffic lanes on a two-way highway. The marker has an upstanding flag with reflective sheeting on both sides to provide a visual marker for traffic moving in opposite directions.

Highway marker 50 includes a cylindrical base 52, similar to base 14 of marker 10, with an upstanding central tab 54 having opposed sides 56 and 58 facing in opposite directions. Each face 56, 58 extends from the upper surface of base 52 at 4° to the vertical. The faces each include a recess 60 like recess 32, a retaining lip and an entrance slot like those described in connection with the tab of highway marker 10. Reflective sheeting 62 is confined within each recess 60 to provide a two-way visable indication of the location of marker 50 in the pavement. Similarly to marker 10, the base of marker 50 may also include a number of retaining projections 64.

As illustrated in FIG. 6, tab 54 extends generally diametrically across the base 52. The distance between the base of the tab at each side 56, 58 thereof and the adjacent side wall of the base 52 is greater than the height of the tab above the upper surface of the base. This permits the tab 54 to be bent down flush against the upper surface of the base below the pavement as illustrated. For this reason, highway marker 50 is used to mark the center line of two-way highways where traffic may bend down the tab in either direction.

While the bases of markers 10 and 50 have been described as being cylindrical, they may be of different shapes, so long as the upper surface are sufficiently large to permit the tab to be bent down on the surface without overlapping the edge of the base.

While I have illustrated and described preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A highway marker comprising an integral resilient flexible body having a base adapted to be mounted on a support and a tab extending upwardly from the upper surface of the base; a reflective member-receiving recess on one sid of the tab and a retaining lip extending around the recess away from the bottom side, the ends of the lip being spaced from the bottom side, the space between the ends of the lip on both sides of the recess and the bottom side of the recess defining an insertion slot; and a reflective member conforming to the shape of the recess and located within the recess sandwiched between the lip and the bottom of the recess, whereby the member may be inserted into or removed from the recess by flexing the tab down against the base with the one side thereof away from the base to open the slot for movement of the member through the slot.

2. A highway marker as in claim 1 wherein said tab extends away from the middle of the base, and including a second reflective-member receiving recess on the other side of the tab with a lip extending partially around such recess and a slot at the bottom side of such recess, and a pair of reflective members each having a shape conforming to its respective recess with each member seated within such recess to reflect back light directed thereon.

3. A highway marker as in claim 2 wherein each reflecting member is angled back from the vertical by about 4°.

4. A highway marker as in claim 1 wherein said body is formed of a rubbery material having a durometer hardness of about 60.

5. A highway marker as in claim 1 wherein said base is generally cylindrical in shape.

6. A highway marker as in claim 1 wherein the distance from the bottom of the other side of the tab to the adjacent edge of the base is greater than the height of the tab.

* * * * *

UNITED STATES PATENT OFFICE

CERTIFICATE OF CORRECTION

PATENT NO. : 4,111,581
DATED : September 5, 1978
INVENTOR(S) : Robert S. Auriemma It is certified that error appears in the above-identified patent and that said Letters Patent are hereby corrected as shown below:

In the specification, column 2, line 14 change "radical" to --radial--.

In claim 1, line 5 "sid" should read --side--.

Signed and Sealed this

Sixth Day of March 1979

[SEAL]

*Attest:*

RUTH C. MASON
*Attesting Officer*

DONALD W. BANNER
*Commissioner of Patents and Trademarks*